United States Patent [19]

Ogawa et al.

[11] Patent Number: 4,944,914

[45] Date of Patent: Jul. 31, 1990

[54] TITANIUM BASE ALLOY FOR SUPERPLASTIC FORMING

[75] Inventors: Atsushi Ogawa; Hiroyoshi Suenaga; Kuninori Minakawa, all of Tokyo, Japan

[73] Assignee: NKK Corporation, Tokyo, Japan

[21] Appl. No.: 443,930

[22] Filed: Nov. 30, 1989

[30] Foreign Application Priority Data

Dec. 24, 1988 [JP] Japan ..... 63-327316

[51] Int. Cl.[5] ..... C22C 14/00

[52] U.S. Cl. ..... 420/418; 148/11.5 F; 148/12.7 B; 148/133; 148/421

[58] Field of Search ..... 420/418; 148/12.7 B, 148/11.5 F, 133, 421

[56] References Cited

U.S. PATENT DOCUMENTS 4,299,626 11/1981 Paton et al. ..... 420/418

4,886,559 12/1989 Shindo et al. ..... 148/421

OTHER PUBLICATIONS

Ghosh et al., Met. Trans. 13A (May 1982) 733.

Wert et al., Met. Trans. 14A (Dec. 1983) 2535.

Leader et al., Met Trans. 17A (Jan. 1986) 93.

*Primary Examiner*—Upendra Roy

*Attorney, Agent, or Firm*—Frishauf, Holtz, Goodman & Woodward

[57] ABSTRACT

The invention provides a titanium alloy having improved superplastic forming characteristics and mechanical characteristics. A titanium alloy having superplastic forming characteristics consisting essentially of about 5.5 to 6.75 wt. % Al, 3.5 to 4.5 wt. % V, 0.01 to 0.2 wt. % O, 0.85 to 3.15 wt. % Fe, 0.85 to 3.25 wt. % Mo, with 2×Fe wt. %+Mo wt. % being from 3 to 8, and balance titanium; said alloy containing α-crystals having a grain size below about 6 μm in diameter. The Fe and Mo act as β-stabilizing elements and contributing elements to lowering the beta transus and to the improvement of the superplastic characteristics.

23 Claims, 4 Drawing Sheets

TITANIUM BASE ALLOY FOR SUPERPLASTIC FORMING

BACKGROUND OF THE INVENTION

1. Field of the Invention

The invention relates to the field of metallurgy and particularly to the field of titanium base alloys having excellent superplastic forming properties.

2. Description of the Prior Art

Titanium alloys are widely used as aerospace materials, e.g., in aeroplanes and rockets since the alloys possess tough mechanical properties and are comparatively light.

Titanium alloys are difficult materials to work. When finished products have a complicated shape, the yield in terms of weight of the product relative to that of the original material is low, which causes a significant increase in the production cost.

To avoid these disadvantages, a new technology called superplastic forming which utilizes the superplastic phenomena, has been proposed. Superplasticity is the phenomena in which materials under certain conditions, are elongated up to from several hundred to one thousand percent, and in some cases, over one thousand percent, without necking down. Superplasticity can be classified in two categories, namely the transformation superplasticity which utilizes isothermal transformation of materials, and the fine-grain superplasticity which is found in materials in which grain size is very small. The industrially important superplasticity is the latter, that is, the fine-grain superplasticity.

One of the titanium alloys which possess superplastic properties is Ti-6Al-4V. U.S. Pat. No. 4,299,626 discloses titanium alloys in which Fe, Ni, and/or Co are added to Ti-6Al-4V to improve superplastic properties.

However, even with the Ti-6Al-4V alloy having a microstructure in which the grain size is in the fine range of 5 to 10 μm, the temperature for superplastic forming is the high temperature of from 875° to 950° C., which shortens the life of working tools or necessitates costly tools. Even with the alloy described in U.S. Pat. No. 4,299,626, the said temperature can be lowered by only 50° to 80° C. compared with that for Ti-6Al-4V alloy, and the elongation obtained at such a temperature range is not sufficient.

SUMMARY OF THE INvENTION

It is an object of the invention to provide a titanium alloy having improved superplastic properties.

It is an object of the invention to provide a Ti-6Al-4V type alloy having improved superplastic properties.

According to the invention a titanium alloy is provided with approximately 6% Al and 4% V, with 0.01 to 0.2 wt. % 0 as a contributing element to the enhancement of the mechanical properties, and 0.85 to 3.15 wt. % Fe together with 0.85 to 3.15 wt. % Mo, as beta stabilizers and contributing elements to the lowering of the beta transus, with the following requirement:

$$3 \text{ wt. } \% \leqq 2 \times \text{Fe wt. } \% + \text{Mo wt. } \% \leqq 8 \text{ wt. } \%$$

and having the grain size of the alpha crystals below about 6 μm in diameter.

In a preferred embodiment, the alloy contains 1.5 to 2.5 wt. % Fe and 1.5 to 2.5 wt. % Mo, which improves the superplastic formability.

These and other objects and features of the present invention will be apparent from the following detailed description.

DESCRIPTION OF THE PREFERRED EMBODIMENT

Figure 1:
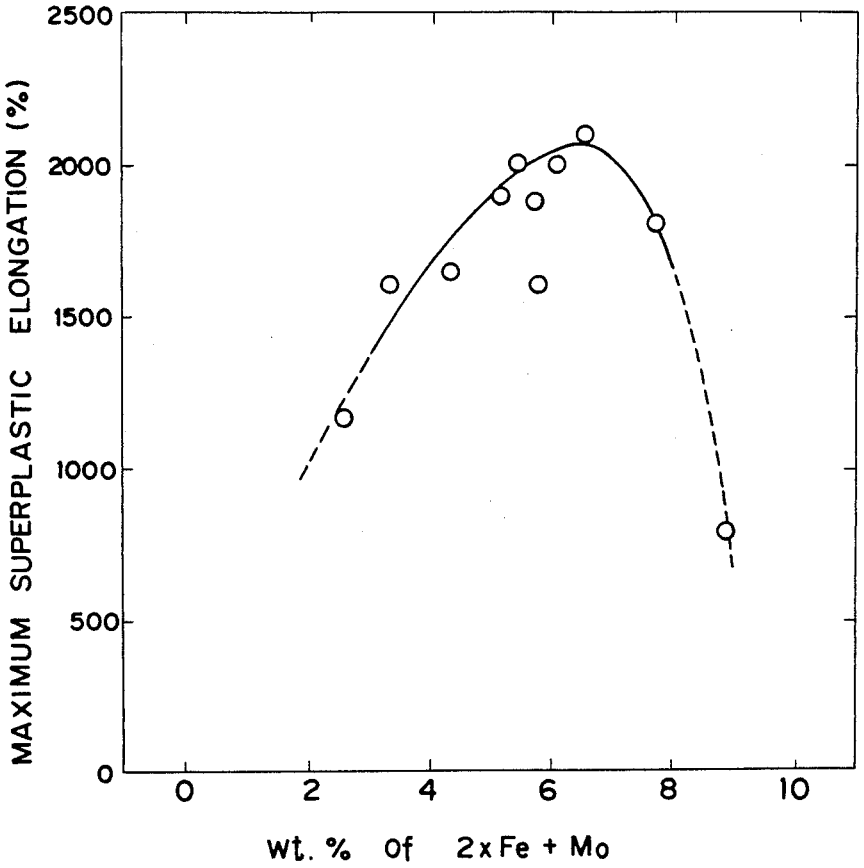
FIGS. 1, 2 and 3 are graphs showing the change of the maximum superplastic elongation of the titanium alloys with respect to the addition of Mo and/or Fe to Ti-6Al-4V alloys.

The most popular alloy in use is the Ti-6Al-4V alloy, and there is substantial technological information concerning the melting and working thereof. The present invention provides an improved Ti-6Al-4V type alloy.

To obtain a titanium alloy with high strength and superplastic properties, the microstructure of the alloy should be composed of equiaxial α-crystals. In order to realize the superplastic phenomena, the volume ratio of the α-crystals in the microstructure should be from 40 to 60%. In order to lower the temperature wherein the superplastic phenomena occur, the β-transus, that is, the temperature wherein β-phase is transformed to α+-β-phase is lowered by adding Mo and Fe.

Although Fe contributes to the increase of mechanical strength, when the Fe content is above 3.15 wt. %, it forms brittle intermetallic compounds with titanium, or forms a segregation phase called "beta fleck" when the alloy is melted, which lowers the mechanical properties. Mo also contributes to the increase of mechanical strength, but when the Mo content is over 3.15 wt. %, it increases the specific weight of the titanium alloy and the characteristic of titanium alloys of having a high strength/weight ratio is lost, and it increases the resistance of deformation since Mo is an element of low diffusivity in β-phase.

2×Fe wt. %+Mo wt. % is an index for the stability of the β-phase. When this value is small, the β-transus becomes high and vice versa.

The optimum temperature for superplasticity is the temperature wherein the volume ratio of the α-phase is from 40 to 60%. This temperature has a close relationship to the β-transus. If this index exceeds 8 wt. %, the temperature wherein the volume ratio of the α-phase is from 40 to 60%, will be excessively lowered, and the diffusion becomes insufficient, which gives rise to insufficient superplastic elongation. If this index is lower than 3 wt. %, the temperature wherein the superplasticity is realized, will not be lowered.

Fine-grain superplasticity depends on the grain size to a great extent; the smaller grain size, the better the superplastic properties. If the grain size of the α-crystals exceeds 6 μm, the superplastic properties will be lowered.

The titanium alloys of the present invention contain the following elements as their major components, namely, Al, V, O, Fe, and Mo. The invention specifies the range of weight percent of these elements as follows:

1. Al is added to titanium as an α-stabilizer for the α+β alloy, which contributes to the increase of mechanical strength. When the Al content is below 5.5 wt. %, sufficient strength which is an object of this invention cannot be obtained. When the Al content exceeds 6.75 wt. %, an $\alpha_2$-phase, a brittle phase composed of $Ti_3Al$ is precipitated, and the mechanical properties are lowered. Accordingly, the Al content is determined to be 5.5 to 6.75%.

2. V is added to titanium as a $\beta$-stabilizer for the $\alpha+\beta$ alloy, which contributes to the increase of mechanical strength without forming brittle intermetallic compounds with titanium. When the V content is below 3.5 wt. %, sufficient strength which is an object of this invention cannot be obtained. When the V content exceed 4.5 wt. %, the superplastic elongation is decreased, and the resistance of deformation in superplastic forming is increased. Accordingly, the V content is determined to be 3.5 to 4.5%.

3. Oxygen contributes to the increase of mechanical strength by constituting a solid solution mainly in the $\alpha$-phase. When the oxygen content exceeds 0.2 wt. % the $\beta$-transus is elevated and the mechanical properties, especially the ductility at room temperature are deteriorated. It is industrially difficult to produce titanium alloy having an oxygen content of less than 0.01 wt. %. Accordingly, the oxygen content is determined to be 0.01 to 0.2%.

4. Fe is added to titanium as a $\beta$-stabilizer for the $\alpha+\beta$ alloy, and contributes to the enhancement of superplastic properties, that is, the increase of superplastic elongation, and the decrease of resistance of deformation, by lowering the $\beta$-transus, and to the increase of mechanical strength by constituting a solid solution in the $\beta$-phase. However, this contribution is insufficient when the Fe content is below 0.85 wt. %. When the Fe content exceeds 3.15 wt. %, Fe forms brittle intermetallic compounds with titanium, and generates a segregation phase called "beta fleck" when the alloy is melted, which leads to the deterioration of the mechanical properties, especially ductility. Accordingly, the Fe content is determined to be 0.85 to 3.15 wt. %.

More specifically, the Fe content is preferably from 0.85 to 1.5 wt. %, in view of avoiding the aforediscussed segregation, and from 2.5 to 3.15 wt. % in view of the enhancement of the mechanical properties, explained above. It is preferable from 1.5 to 2.5 wt. % in view of the balance of the superplastic and mechanical properties.

5. Mo is added to titanium as a $\beta$-stabilizer for the $\alpha+\beta$ alloy, and contributes to the enhancement of superplastic properties, that is, the lowering of the temperature wherein the superplasticity is realized, by lowering the $\beta$-transus, and to the increase of mechanical strength by constituting a solid solution in the $\beta$-phase. However, this contribution is insufficient when the Mo content is below 0.85 wt. %. When the Mo content exceeds 3.15 wt. %, Mo increases the specific weight of the alloy due to the fact that Mo is a heavy metal, and the characteristic high strength/weight ratio of titanium alloys is lost.

Moreover, Mo has a low diffusion rate in titanium, which increases the deformation stress in superplastic forming. Accordingly, the Mo content is determined to be 0.85 to 3.15 wt. %.

More specifically, the Mo content is preferably from 0.85 to 1.5 wt. %, in view of the specific weight of the alloy as explained above and from 2.5 to 3.15 wt. % in view of the enhancement of the mechanical properties as explained above. It is preferably from 1.5 to 2.5 wt. %, in view of the balance of the specific weight of the alloy and the mechanical properties.

6. $2\times$Fe wt. %+Mo wt. % is an index for the stability of the $\beta$-phase. When said index is small, the $\beta$-transus is low and vice versa. The optimum temperature for superplasticity is the temperature wherein the volume ratio of the $\alpha$-phase is from 40 to 60%. This temperature has a close relationship with the $\beta$-transus.

When this index is below 3 wt. %, the temperature wherein the superplastic characteristics are realized is undesirably increased. When this index exceeds 8 wt. %, the temperature wherein the volume ratio of the $\alpha$-phase is from 40 to 60%, is excessively lowered, and the diffusion becomes insufficient, which gives rise to insufficient superplastic elongation. This index is preferably from 5 to 8 and more preferably from 5.5 to 7.

7. The grain size of the $\alpha$-crystals has a substantive relationship to the superplastic properties. The smaller the grain size the better the superplastic properties. In this invention, when the grain size of the $\alpha$-crystals exceeds 6 $\mu$m, the superplastic elongation is decreased and the resistance of deformation is increased. Accordingly, the grain size of $\alpha$-crystals is determined to be below 6 $\mu$m.

8. Various combinations of Fe and Mo content within the ranges specified above, can be made according to the required properties of the alloy. The maximum superplastic elongation of over 2000% is obtained when the Fe content is from 1.5 to 2.5% and the Mo content is from 1.5 to 2.5%.

9 The alloys of the present invention may contain minor additions of other elements and/or impurities which do not change the essential characteristics of these alloys.

EXAMPLES

Table 1 reports the chemical composition and Tables 2 and 3 report the grain size of the $\alpha$-crystals, the mechanical properties at room temperature, namely, 0.2% proof stress (PS), tensile strength (TS), and elongation (EL), and the superplastic properties, namely, the maximum superplastic elongation, the temperature wherein the maximum superplastic deformation is obtained, and the maximum stress of deformation at said temperature, (i) of the titanium alloys of the invention, namely Nos. 1–9; (ii) of conventional Ti-6Al-4V alloys, namely Nos. 10 and 11; (iii) of titanium alloys disclosed in U.S. Pat. No. 4,299,626, namely Nos. 12 and 13; and (iv) of other titanium alloys for comparison, namely Nos. 14–26. These alloys were melted and worked as follows:

Alloy ingots remelted by an arc furnace under an argon atmosphere are hot forged and then hot rolled into plates 5 mm thick. To obtain a fine equiaxed $\alpha$-crystal structure, the forged ingots are hot rolled in the temperature range of the $\alpha+\beta$-dual phase with sufficient reduction, followed by a recrystallization annealing.

Samples taken from these plates were tested for mechanical properties at room temperature, namely, 0.2% proof stress, tensile strength, and elongation, as shown in Table 2.

For the tensile test for superplasticity, samples were cut from the plates with the following dimensions: 5 mm width by 5 mm length by 4 mm thickness and tested under a pressure of $5\times10^{-6}$ torr. The test results are set forth in Table 3, reporting the maximum superplastic elongation, the temperature wherein the maximum superplastic elongation is obtained, and the maximum deformation stress at said temperature. The maximum deformation stress is obtained by dividing the maximum test load by original sectional area.

TABLE 1

| NO. | Chemical Composition Al | V | Mo | Fe | O | 2.Fe + Mo |
|---|---|---|---|---|---|---|
| 1 | 5.83 | 4.43 | 2.11 | 1.98 | 0.12 | 6.07 |
| 2 | 6.45 | 3.57 | 1.59 | 0.86 | 0.19 | 3.31 |
| 3 | 6.21 | 4.31 | 1.11 | 2.16 | 0.14 | 4.32 |
| 4 | 6.07 | 4.34 | 2.33 | 1.56 | 0.09 | 5.45 |
| 5 | 6.11 | 3.56 | 2.22 | 2.17 | 0.08 | 6.56 |
| 6 | 5.97 | 4.21 | 0.94 | 2.42 | 0.11 | 5.78 |
| 7 | 6.17 | 3.55 | 2.11 | 2.79 | 0.07 | 7.69 |
| 8 | 6.04 | 3.67 | 1.35 | 2.19 | 0.09 | 5.73 |
| 9 | 5.98 | 4.07 | 3.01 | 1.07 | 0.08 | 5.15 |
| 10 | 6.03 | 4.25 | — | 0.25 | 0.17 | 0.50 |
| 11 | 6.11 | 4.07 | — | 0.08 | 0.12 | 0.16 |
| 12 | 6.17 | 4.01 | — | Fe:1.22 Co:0.91 | 0.19 | — |
| 13 | 6.24 | 3.93 | — | Fe:0.22 Co:0.88 Ni:0.93 | 0.19 | — |
| 14 | 3.97 | 2.01 | 1.12 | 0.98 | 0.11 | 3.08 |
| 15 | 7.02 | 3.97 | 0.98 | 1.07 | 0.14 | 3.12 |
| 16 | 5.73 | 4.82 | 2.76 | 2.50 | 0.13 | 7.76 |
| 17 | 6.71 | 4.37 | 3.45 | 2.25 | 0.12 | 7.95 |
| 18 | 6.21 | 3.65 | 0.73 | 1.17 | 0.16 | 3.07 |
| 19 | 6.17 | 3.70 | 1.57 | 0.76 | 0.13 | 3.09 |
| 20 | 5.89 | 4.22 | 1.39 | 3.30 | 0.14 | 7.99 |
| 21 | 6.40 | 4.17 | 2.80 | 2.51 | 0.22 | 7.82 |
| 22 | 6.53 | 3.84 | 0.85 | 0.86 | 0.16 | 2.57 |
| 23 | 5.94 | 4.31 | 2.70 | 3.08 | 0.11 | 8.86 |
| 24 | 5.97 | 4.03 | 2.13 | 1.98 | 0.14 | 6.09 |
| 25 | 6.04 | 3.99 | 1.13 | 2.13 | 0.12 | 5.39 |
| 26 | 5.99 | 4.13 | 2.01 | 1.13 | 0.15 | 4.27 |

TABLE 2

| No. | grain size of α-crystals (μm) | tensile properties at room temperature 0.2% PS (Kg f/mm²) | TS (Kg f/mm²) | El (Kg f/mm²) |
|---|---|---|---|---|
| 1 | 2.3 | 104.4 | 109.0 | 24.0 |
| 2 | 3.4 | 100.3 | 105.6 | 23.7 |
| 3 | 5.1 | 105.0 | 109.3 | 23.5 |
| 4 | 2.1 | 105.1 | 109.0 | 19.5 |
| 5 | 2.5 | 106.3 | 111.1 | 17.8 |
| 6 | 5.7 | 107.2 | 112.4 | 18.0 |
| 7 | 2.9 | 109.8 | 114.6 | 21.7 |
| 8 | 4.2 | 108.6 | 112.7 | 20.8 |
| 9 | 3.8 | 107.9 | 111.4 | 21.9 |
| 10 | 6.2 | 85.9 | 93.3 | 18.9 |
| 11 | 6.7 | 82.7 | 90.1 | 20.2 |
| 12 | 3.5 | 104.2 | 108.5 | 17.4 |
| 13 | 4.1 | 102.5 | 106.8 | 21.0 |
| 14 | 7.2 | 90.4 | 95.7 | 21.3 |
| 15 | 5.9 | 106.7 | 111.3 | 13.0 |
| 16 | 3.2 | 115.6 | 119.4 | 10.3 |
| 17 | 3.0 | 119.4 | 124.3 | 8.4 |
| 18 | 5.9 | 103.2 | 108.1 | 17.3 |
| 19 | 4.3 | 98.7 | 103.4 | 21.3 |
| 20 | 2.8 | 118.9 | 124.1 | 9.7 |
| 21 | 3.7 | 121.7 | 126.4 | 6.3 |
| 22 | 5.9 | 96.3 | 100.7 | 19.4 |
| 23 | 3.0 | 120.3 | 125.6 | 9.2 |
| 24 | 7.4 | 102.4 | 108.1 | 20.3 |
| 25 | 10.7 | 98.3 | 104.7 | 19.7 |
| 26 | 13.5 | 102.1 | 107.7 | 17.4 |

TABLE 3

| No. | Em (%) | Tm (°C.) | δm (Kg f/mm²) |
|---|---|---|---|
| 1 | 1986 | 800 | 1.21 |
| 2 | 1603 | 800 | 1.11 |
| 3 | 1647 | 800 | 1.19 |
| 4 | 2004 | 800 | 1.08 |
| 5 | 2107 | 775 | 1.32 |
| 6 | 1603 | 800 | 1.18 |
| 7 | 1798 | 775 | 1.34 |
| 8 | 1874 | 800 | 1.17 |
| 9 | 1877 | 800 | 1.09 |
| 10 | 982 | 875 | 1.25 |
| 11 | 925 | 900 | 1.03 |
| 12 | 1328 | 825 | 1.07 |
| 13 | 1385 | 825 | 1.02 |
| 14 | 884 | 900 | 0.92 |
| 15 | 1213 | 875 | 1.28 |
| 16 | 583 | 775 | 2.11 |
| 17 | 999 | 775 | 2.34 |
| 18 | 1356 | 825 | 1.15 |
| 19 | 1408 | 825 | 1.24 |
| 20 | 1341 | 750 | 2.58 |
| 21 | — | — | — |
| 22 | 1163 | 825 | 1.17 |
| 23 | 784 | 750 | 2.87 |
| 24 | 1209 | 775 | 1.53 |
| 25 | 943 | 775 | 1.57 |
| 26 | 802 | 800 | 1.23 |

Em maximum superplastic elongation
Tm temperature wherein the maximum superplastic elongation is obtained.
δm maximum stress of deformation at Tm °C.

FIG. 1 reports the change of the maximum superplastic elongation of the titanium alloys with respect to the addition of Mo and Fe to the titanium alloys of conventional alloying content, namely, Ti-6Al-4V. The abscissa denotes 2×Fe wt. %+Mo wt. %, and the ordinate denotes the maximum superplastic elongation.

As is reported in FIG. 1, superplastic elongation of over 1500% is obtained in the range of 2×Fe wt. %+Mo wt. % of 3 to 8 wt. % with higher elongations in the range of 5 to 8% and the highest elongations in the range of 5.5 to 7%.

Figure 2:
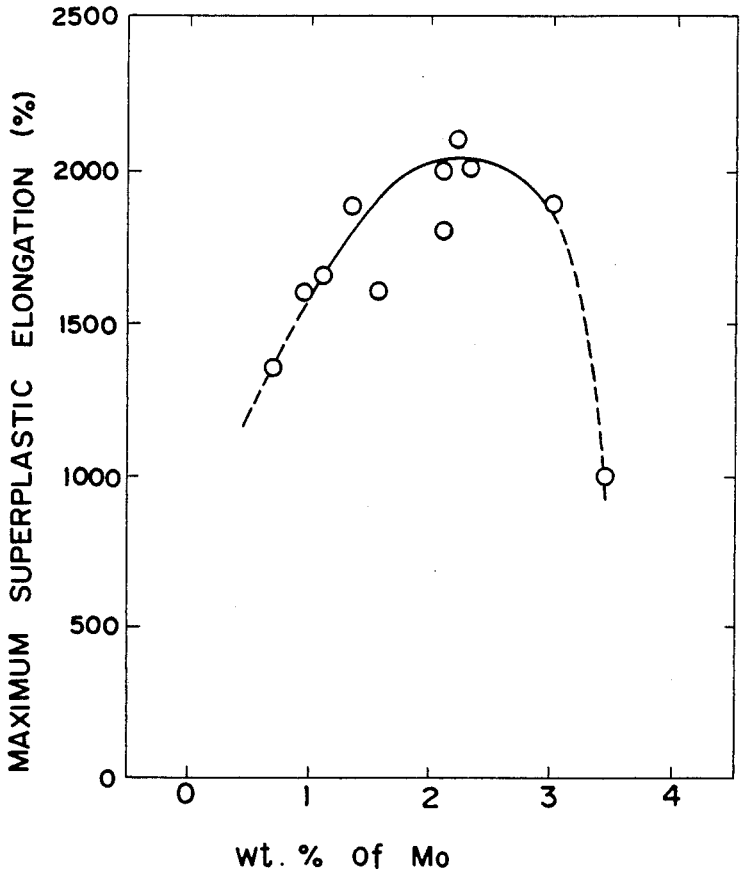

FIG. 2 reports the change of the maximum superplastic elongation of the titanium alloys with respect to the addition of Mo to the titanium alloys of conventional alloying content, namely, Ti-6Al-4V. The abscissa denotes Mo wt. %, and the ordinate denotes the maximum superplastic elongation.

As reported in FIG. 2, the maximum superplastic elongation of over 1500% is obtained in the range of Mo wt. % of 0.85 to 3.15 wt. %.

Figure 3:
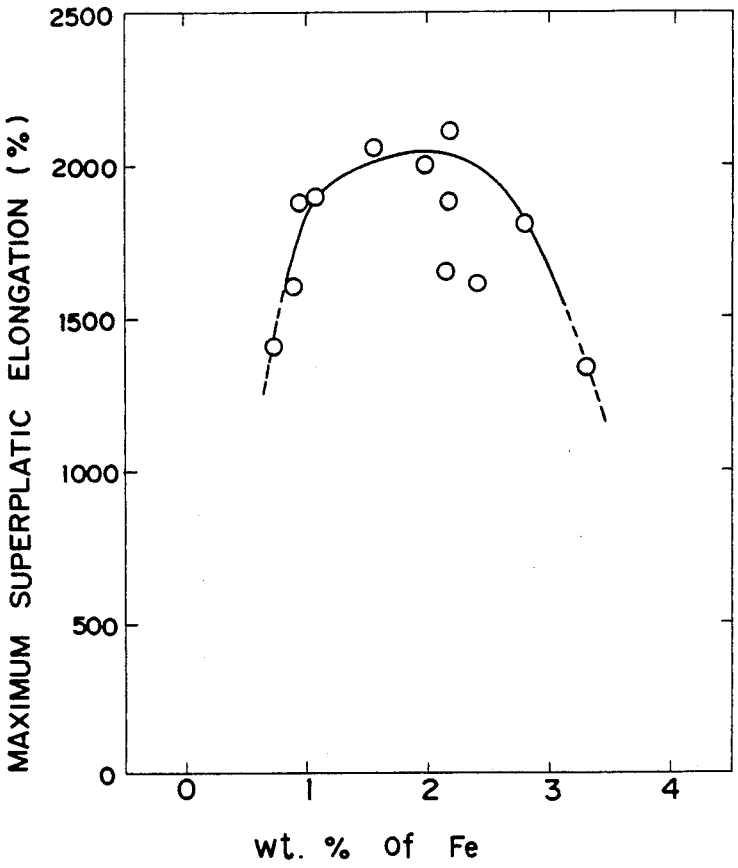

FIG. 3 reports the change of the maximum superplastic elongation of the titanium alloys with respect to the addition of Fe to the titanium alloys of conventional alloying content, namely, Ti-6Al-4V. The abscissa denotes Fe wt. %, and the ordinate denotes the maximum superplastic elongation.

As reported in FIG. 3, superplastic elongation of over 1500% is obtained in the range of Fe wt. % of 0.85 to 3.15 wt. %.

Figure 4:
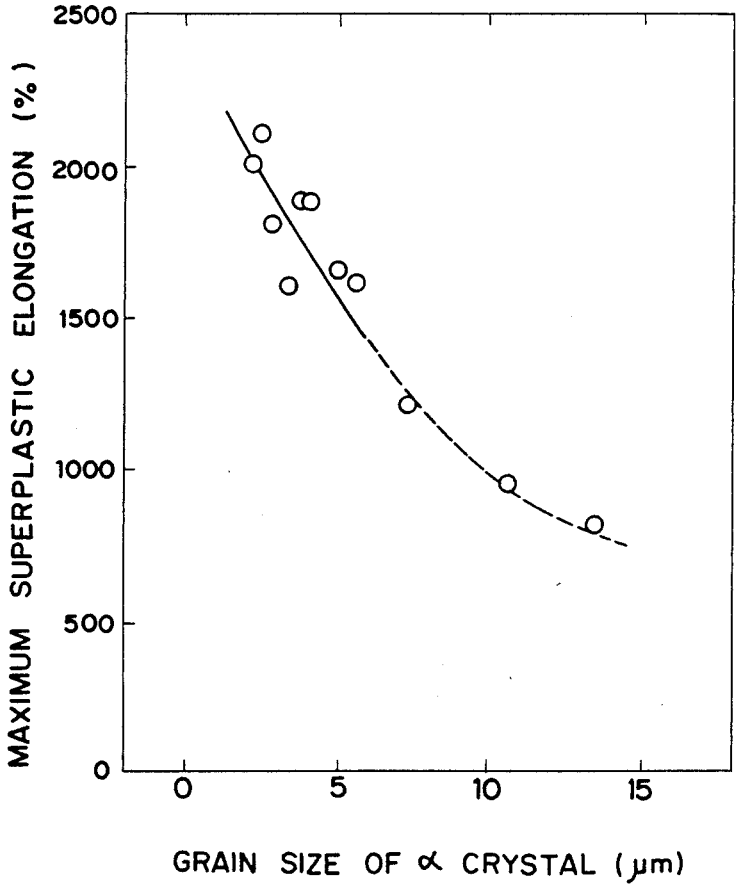
FIG. 4 is a graph showing the change of the maximum superplastic elongation of the titanium alloys with respect to the grain size of the α-crystals of titanium alloys having the chemical composition of the alloys of the present invention.

FIG. 4 reports the change of the maximum superplastic elongation of the titanium alloys of the present invention with respect to the change of the grain size of the α-crystals thereof. The abscissa denotes the grain size of the α-crystals of the titanium alloys, and the ordinate denotes the maximum superplastic elongation.

As shown in the FIG. 4, elongations of over 1500% are obtained when the grain size of the α-crystals is 6 μm or less.

As shown in Table 2, the tensile properties of the alloys of the present invention, Nos. 1–9, have a tensile strength of at least 105 kgf/mm$^2$ and an elongation of at least 17%. This is higher in tensile strength and elongation than the values for these properties for the Ti-6Al-4V alloys. Therefore, the alloys of the present invention have a superior strength ductility balance.

Furthermore, the temperature wherein the maximum superplastic elongation is realized is as low as 800° C. for the alloys of the present invention and the maximum superplastic elongation at said temperature is over 1500%, whereas with conventional Ti-6Al-4V alloys Nos. 10 and 11, and titanium alloys Nos. 14 to 26, the comparison alloys, the superplastic elongation is around 1000%, or about 1400% in Nos 19 with the temperature for the realization of superplasticity for No. 19 being 825° C. The alloys of the present invention, Nos. 1–9 are superior to the conventional alloys Nos. 10 and 11, and the comparison alloys in superplastic properties. The alloys of the present invention, Nos. 1–9 exhibit a stress of deformation which is lower than 1.4 kgf/mm$^2$ in spite of the fact that the temperature for the realization of the maximum superplastic elongation is lower than those of the conventional Ti-6Al-4V alloys by 75 to 100° C.

The comparison alloys Nos. 15 and 19 possess a comparatively large elongation of more than 1210%. However, the temperature for the realization of maximum superplastic deformation is 875° C. and 825° C., respectively, which is higher than that of the alloys of the present invention. Accordingly, their superplastic properties are inferior to those of the alloys of the present invention.

In the comparison alloy, No. 20, the superplastic elongation of 1341% is obtained at the temperature of 750° C. However, its stress of deformation reaches the very large value of 2.58 kgf/mm$^2$.

In the comparison alloy, No. 21, the elongation at room temperature is the small value of 6.3%, which is not in the range of practical use. Therefore, the superplasticity test is not necessary for the sample.

The alloys of the present invention, Nos. 1–9, are superior to the conventional alloys described in U.S. Pat. No. 4,299,626 with respect to the maximum superplastic elongation and the temperature wherein the maximum superplastic elongation is realized. As disclosed herein, the alloys of the present invention, possess superior (1) mechanical properties at room temperature, especially tensile strength, and superior (2) superplastic properties, when compared to the conventional Ti-6Al-4V alloys, and to the alloys wherein Fe, Co, and Ni are added to the Ti-6Al-4V alloys. The alloys of the present invention are useful as an aerospace material which utilizes their superior properties, namely their high strength titanium alloy characteristics combined with their excellent superplastic formability.

It will be appreciated that the present invention is not limited to the precise embodiments illustrated above, and that various changes and modifications may be effected therein by one of ordinary skill in the art without departing from the scope or spirit of the invention as defined in the appended claims.

What is claimed is:

1. A titanium alloy having superplastic forming characteristics consisting essentially of about 5.5 to 6.75 wt. % Al, 3.5 to 4.5 wt. % V, 0.85 to 3.15 wt. % Fe, 0.85 to 3.25 wt. % Mo, with 2×Fe wt. %+Mo wt. % being from 3 to 8, 0.01 to 0.2 wt. % oxygen and the balance titanium; said alloy containing α-crystals having a grain size below about 6 μm in diameter.

2. The titanium base alloy of claim 1, containing about 1.5 to 2.5 wt. % Mo, and 1.5 to 2.5 wt. % Fe.

3. The titanium base alloy of claim 1, containing about 0.85 to 1.5 wt. % Mo, and 1.5 to 2.5 wt. % Fe.

4. The titanium base alloy of claim 1, containing about 1.5 to 2 5 wt. % Mo, and 0.85 to 1.5 Wt.% Fe.

5. The titanium base alloy of claim 1, containing about 0.85 to 1.5 wt. % of Mo, and 0.85 to 1.5 wt. % Fe.

6. The titanium base alloy of claim 1, containing about 2.5 to 3.15 wt. % Mo, and 0.85 to 1.5 wt. % Fe.

7. The titanium base alloy of claim 1, containing about 0.85 to 1.5 wt. % of Mo, and 2.5 to 3.15 wt. % Fe.

8. The titanium base alloy of claim 1, containing about 1.5 to 2.5 wt. % Mo, and 2.5 to 3.15 wt. % Fe.

9. The titanium base alloy of claim 1, containing about 2.5 to 3.15 wt. % Mo, and 1.5 to 2.5 wt % Fe.

10. The titanium base alloy of claim 1, containing about 2.5 to 3.15 wt. % Mo, and 2.5 to 3.15 wt. % Fe.

11. The titanium base alloy of claim 1, wherein 2×Fe wt. % +Mo wt. % is from 5 to 8.

12. The titanium base alloy of claim 1, wherein 2×Fe wt. % +Mo wt. % is from 5.5 to 7.

13. The titanium base alloy of claim 1, containing about 5.8 to 6.5 wt. % Al.

14. The titanium base alloy of claim 1, containing about 0.07 to 0.2 wt. % oxygen.

15. The titanium base alloy of claim 2, wherein 2×Fe wt. % +Mo wt. % is from 5.5 to 7.

16. The titanium base alloy of claim 3, wherein 2×Fe wt. % +Mo wt. % is from 5.5 to 7.

17. The titanium base alloy of claim 4, wherein 2×Fe wt. % +Mo wt. % is from 5.5 to 7.

18. The titanium base alloy of claim 5, wherein 2×Fe wt. % +Mo wt. % is from 5.5 to 7.

19. The titanium base alloy of claim 6, wherein 2×Fe wt. % +Mo wt. % is from 5.5 to 7.

20. The titanium base alloy of claim 7, wherein 2×Fe wt. % +Mo wt. % is from 5.5 to 7.

21. The titanium base alloy of claim 8, wherein 2×Fe wt. % +Mo wt. % is from 5.5 to 7.

22. The titanium base alloy of claim 9, wherein 2×Fe wt. % +Mo wt. % is from 5.5 to 7.

23. The titanium base alloy of claim 10, wherein 2×Fe wt. % +Mo wt. % is from 5.5 to 7.

* * * * *